US012312773B2

(12) United States Patent
Nishikawara

(10) Patent No.: US 12,312,773 B2
(45) Date of Patent: May 27, 2025

(54) EXCAVATOR

(71) Applicant: SUMITOMO CONSTRUCTION MACHINERY CO., LTD., Tokyo (JP)

(72) Inventor: Riichi Nishikawara, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 18/632,668

(22) Filed: Apr. 11, 2024

(65) Prior Publication Data

US 2024/0254729 A1 Aug. 1, 2024

Related U.S. Application Data

(63) Continuation of application No. PCT/JP2022/040243, filed on Oct. 27, 2022.

(30) Foreign Application Priority Data

Oct. 29, 2021 (JP) ..... 2021-178370

(51) Int. Cl.
*E02F 9/22* (2006.01)

(52) U.S. Cl.
CPC ..... *E02F 9/2292* (2013.01); *E02F 9/2282* (2013.01); *E02F 9/2285* (2013.01)

(58) Field of Classification Search
CPC . F15B 11/17; F15B 11/16; F15B 11/02; E02F 9/2239
See application file for complete search history.

(56) References Cited

U.S. PATENT DOCUMENTS 6,330,797 B1 12/2001 Kondo
2005/0204734 A1* 9/2005 Oka ..... E02F 9/2239 60/428
2010/0293936 A1 11/2010 Son
2013/0276441 A1 10/2013 Bae et al.
2014/0158235 A1 6/2014 Suk et al.
2015/0275939 A1* 10/2015 Ueda ..... E02F 9/2292 60/421

(Continued)

FOREIGN PATENT DOCUMENTS

JP H10-088627 4/1998
JP 2003-184815 7/2003

(Continued)

OTHER PUBLICATIONS

International Search Report for PCT/JP2022/040243 mailed on Jan. 10, 2023.

*Primary Examiner* — Abiy Teka
(74) *Attorney, Agent, or Firm* — IPUSA, PLLC

(57) ABSTRACT

An excavator includes an excavation attachment including a boom, an arm, and a bucket, a left main pump and a right main pump mounted on an upper rotating body, a control valve serving as a confluence valve that merges an operating oil discharged from the left main pump and the operating oil discharged from the right main pump with each other, and a controller that can control functioning of the control valve. The controller moves the control valve to merge the operating oil discharged from the left main pump and the operating oil discharged from the right main pump with each other while the boom, the arm, and the bucket are moving simultaneously.

4 Claims, 7 Drawing Sheets

(56) References Cited

U.S. PATENT DOCUMENTS

| | | | |
|---|---|---|---|
| 2017/0204887 | A1 | 7/2017 | Matsuzaki et al. |
| 2023/0212835 | A1 | 7/2023 | Kawamoto |

FOREIGN PATENT DOCUMENTS

| | | | | | |
|---|---|---|---|---|---|
| JP | 2003-301804 | | | 10/2003 | |
| JP | 2005-299376 | | | 10/2005 | |
| JP | 2006-328765 | | | 12/2006 | |
| JP | 2011-085191 | | | 4/2011 | |
| JP | 2011247365 | A | * | 12/2011 | |
| JP | 2012-013169 | | | 1/2012 | |
| JP | 2014-502708 | | | 2/2014 | |
| JP | 2018-105487 | | | 7/2018 | |
| JP | 6434504 | | | 12/2018 | |
| JP | 2021-017927 | | | 2/2021 | |
| JP | 2021-195733 | | | 12/2021 | |
| WO | 2016/056442 | | | 4/2016 | |
| WO | WO-2018164263 | A1 | * | 9/2018 | ..... E02F 3/32 |

* cited by examiner

EXCAVATOR

CROSS-REFERENCE TO RELATED APPLICATIONS

This application is a continuation application of International Application No. PCT/JP2022/040243, filed on Oct. 27, 2022, and designating the U.S., which is based upon and claims priority to Japanese Patent Application No. 2021-178370, filed on Oct. 29, 2021, the entire contents of which are incorporated herein by reference.

BACKGROUND

Technical Field

The present disclosure relates to an excavator.

Background Art

Hitherto, an excavator that can move a plurality of hydraulic actuators simultaneously using an operating oil discharged from hydraulic pumps has been known.

SUMMARY

However, the excavator mentioned above may have difficulty moving three hydraulic cylinders (a boom cylinder, an arm cylinder, and a bucket cylinder) with a good balance while a complex operation for moving the three hydraulic cylinders simultaneously is being performed, because the arm cylinder is driven by an operating oil discharged from a first hydraulic pump, and the boom cylinder and the bucket cylinder are driven by the operating oil discharged from a second hydraulic pump, i.e., because the movement of the arm cylinder is less affected by the movement of the boom cylinder whereas the movement of the bucket cylinder is more affected by the movement of the boom cylinder.

In view of the above, it is desirable to provide an excavator that can move at least three selected from an upper rotating body, a boom, an arm, and a bucket with a good balance while a complex operation for moving the at least three selected from the upper rotating body, the boom, the arm, and the bucket simultaneously is being performed.

An excavator according to an embodiment of the present invention includes a lower travelling body, an upper rotating body mounted rotatably on the lower travelling body, an attachment attached to the upper rotating body and including a boom, an arm, and a bucket, a first hydraulic pump and a second hydraulic pump that are mounted on the upper rotating body, a confluence valve that merges an operating oil discharged from the first hydraulic pump and the operating oil discharged from the second hydraulic pump with each other, and a control device that can control functioning of the confluence valve, wherein the control device moves the confluence valve to merge the operating oil discharged from the first hydraulic pump and the operating oil discharged from the second hydraulic pump with each other while at least three selected from the upper rotating body, the boom, the arm, and the bucket are moving simultaneously.

The excavator described above can move at least three selected from an upper rotating body, a boom, an arm, and a bucket with a good balance while a complex operation for moving the at least three selected from the upper rotating body, the boom, the arm, and the bucket simultaneously is being performed.

DETAILED DESCRIPTION OF THE EMBODIMENTS

Figure 1:
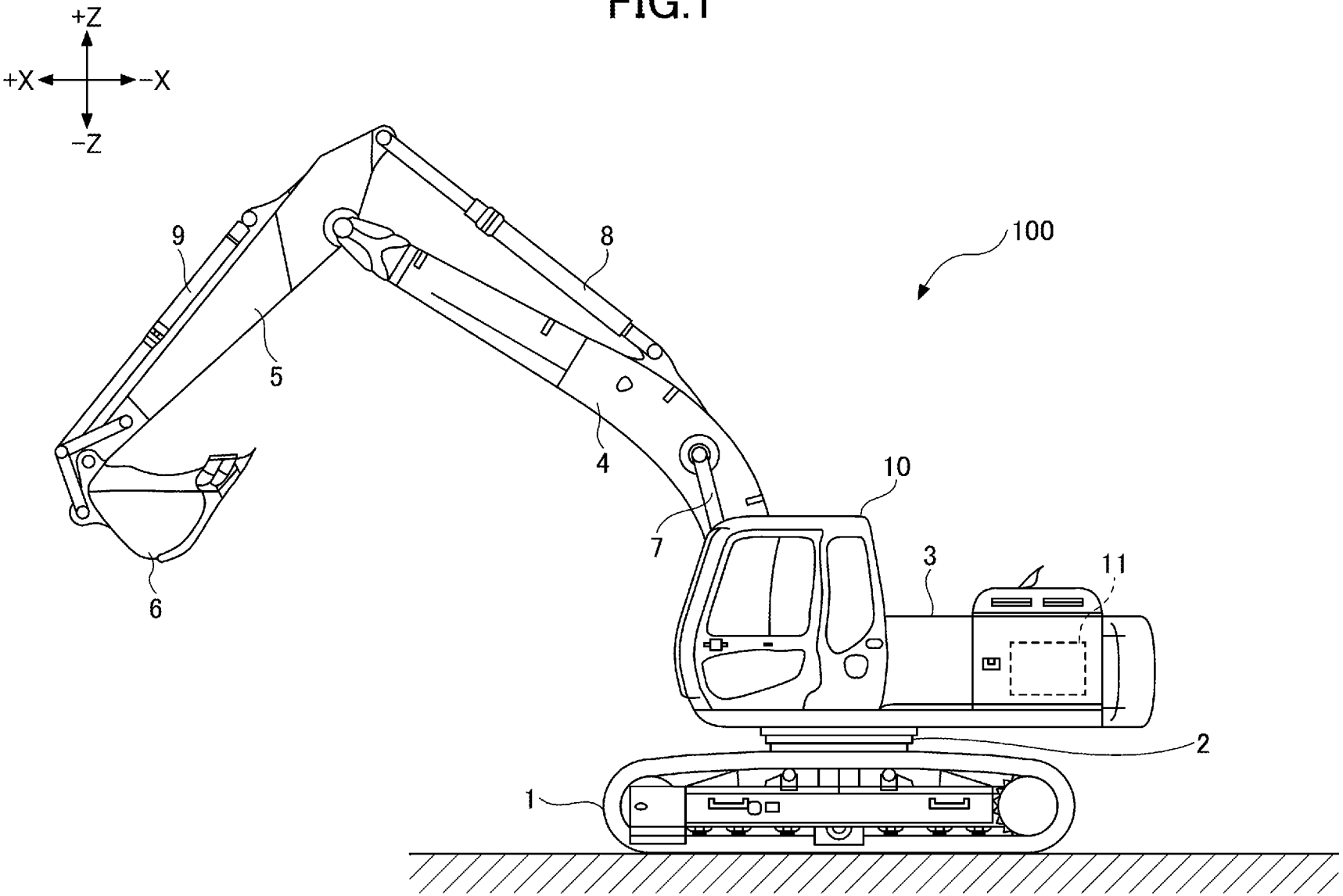
FIG. 1 is a side view of an excavator according to an embodiment of the present invention.

First, an excavator 100 as a construction machine according to an embodiment of the present invention will be described with reference to FIG. 1. FIG. 1 is a side view of the excavator 100. An upper rotating body 3 is mounted on a lower travelling body 1 of the excavator 100 illustrated in FIG. 1 such that the upper rotating body 3 can rotate via a rotating mechanism 2. A boom 4 serving as a working component is attached to the upper rotating body 3. An arm 5 serving as a working component is attached to an end of the boom 4, and a bucket 6 serving as a working component and an end attachment is attached to an end of the arm 5. The boom 4, the arm 5, and the bucket 6 form an excavation attachment, which is an example of the attachment. The boom 4 is driven by a boom cylinder 7, the arm 5 is driven by an arm cylinder 8, and the bucket 6 is driven by a bucket cylinder 9. A cabin 10 is mounted on the upper rotating body 3, and a power source such as an engine 11 or the like is mounted on the upper rotating body 3.

Figure 2:
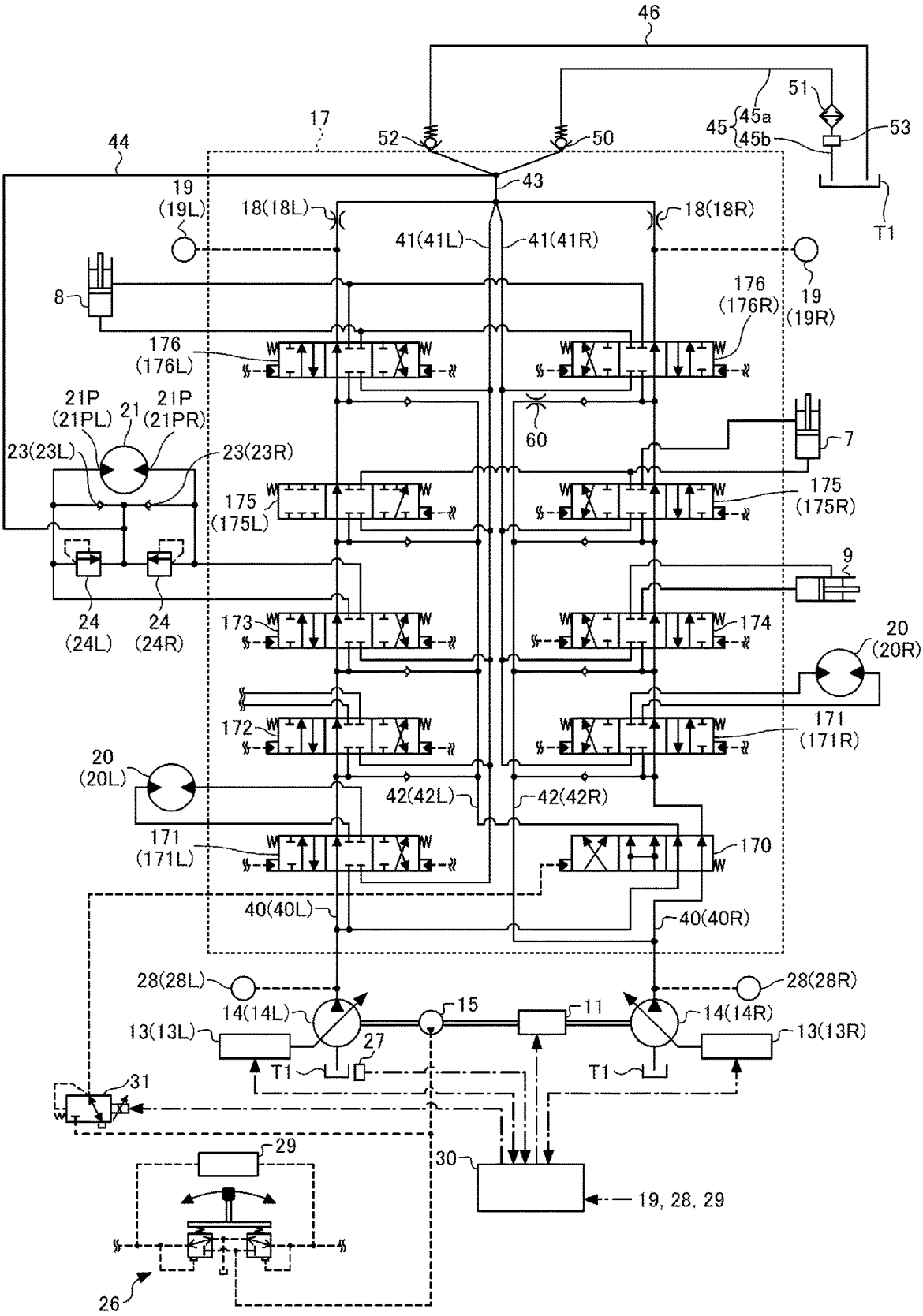
FIG. 2 is a schematic diagram illustrating an example of the configuration of a driving system mounted on the excavator of FIG. 1.

FIG. 2 is a diagram illustrating an example of the configuration of a driving system mounted on the excavator 100 of FIG. 1. In FIG. 2, a mechanical power transmission line is denoted by a double line, operating oil lines are denoted by solid lines, pilot lines are denoted by broken lines, and electric control lines are denoted by dash-dot lines.

The driving system of the excavator 100 mainly includes the engine 11, pump regulators 13, main pumps 14, a pilot pump 15, an operation device 26, discharging pressure sensors 28, an operation sensor 29, a controller 30, and the like.

The engine 11 is an example of a power source of the excavator 100. The power source may be an electric motor, a fuel battery, a hydrogen engine, or the like. In the present embodiment, the engine 11 is a diesel engine that moves while maintaining a predetermined rotation rate. The output shaft of the engine 11 is coupled to the input shafts of the main pumps 14 and of the pilot pump 15.

The main pumps 14 are an example of the hydraulic pumps, and can supply an operating oil to a control valve unit 17. In the present embodiment, the main pumps 14 are swash plate-type variable-displacement hydraulic pumps, and include a left main pump 14L and a right main pump 14R.

The pump regulators 13 control the discharging amounts of the main pumps 14. In the present embodiment, the pump regulators 13 control the discharging amounts of the main pumps 14 by adjusting the tilt angles of the swash plates of the main pumps 14 in accordance with instructions from the controller 30. The pump regulators 13 may output information regarding the tilt angles of the swash plates to the controller 30. Specifically, the pump regulators 13 include a left pump regulator 13L that controls the discharging amount of the left main pump 14L and a right pump regulator 13R that controls the discharging amount of the right main pump 14R.

The pilot pump 15 supplies the operating oil to various hydraulic devices including the operation device 26. In the present embodiment, the pilot pump 15 is a fixed-displacement hydraulic pump. However, the pilot pump 15 may be omitted. In this case, the functions served by the pilot pump 15 may be realized by the main pumps 14. That is, the main pumps 14 may have a function for supplying the operating oil to the operation device 26 and the like after reducing the pressure of the operating oil via throttles or the like, aside from the function for supplying the operating oil to the control valve unit 17.

The control valve unit 17 accommodates a plurality of control valves such that the control valves can move. In the present embodiment, the control valve unit 17 includes the plurality of control valves that control the circulation of the operating oil discharged from the main pumps 14. The control valve unit 17 can supply the operating oil discharged from the main pumps 14 selectively to one or a plurality of hydraulic actuators via the control valves. The plurality of control valves control the flow rates of the operating oil flowing into the hydraulic actuators from the main pumps 14, and the flow rates of the operating oil flowing into an operating oil tank T1 from the hydraulic actuators. The hydraulic actuators include the boom cylinder 7, the arm cylinder 8, the bucket cylinder 9, travelling hydraulic motors 20, and a rotating hydraulic motor 21. The travelling hydraulic motors 20 include a left travelling hydraulic motor 20L and a right travelling hydraulic motor 20R.

The rotating hydraulic motor 21 is a hydraulic motor that rotates the upper rotating body 3. Oil paths 21P connected to the ports of the rotating hydraulic motor 21 are connected to an oil path 44 via relief valves 24 and check valves 23. Specifically, the oil paths 21P include a left oil path 21PL and a right oil path 21PR. The relief valves 24 include a left relief valve 24L and a right relief valve 24R. The check valves 23 include a left check valve 23L and a right check valve 23R.

The left relief valve 24L opens in response to the pressure of the operating oil in the left oil path 21PL reaching a predetermined relief pressure, and expels the operating oil in the left oil path 21PL to the oil path 44. The right relief valve 24R opens in response to the pressure of the operating oil in the right oil path 21PR reaching a predetermined relief pressure, and expels the operating oil in the right oil path 21PR to the oil path 44.

The left check valve 23L opens in response to the pressure of the operating oil in the left oil path 21PL becoming lower than the pressure of the operating oil in the oil path 44, and replenishes the operating oil into the left oil path 21PL from the oil path 44. The right check valve 23R opens in response to the pressure of the operating oil in the right oil path 21PR becoming lower than the pressure of the operating oil in the oil path 44, and replenishes the operating oil into the right oil path 21PR from the oil path 44. The check valves 23 functioning in this way can replenish the operating oil to the ports on the suctioning side during braking of the rotating hydraulic motor 21.

The operation device 26 is a device used by an operator to operate the hydraulic actuators. In the present embodiment, the operation device 26 is a hydraulic type, and supplies the operating oil discharged from the pilot pump 15 to the pilot ports of the control valves corresponding to the respective hydraulic actuators through the pilot lines. The pilot pressure, which is the pressure of the operating oil to be supplied to each pilot port, is a pressure matching the direction in which and the amount by which a lever or a pedal forming the operation device 26 and corresponding to any hydraulic actuator is operated. However, the operation device 26 may be an electric type.

Specifically, the operation device 26 includes a left operation lever, a right operation lever, a left travelling operation lever, a right travelling lever, a left travelling operation pedal, a right travelling pedal, and the like. The left operation lever functions as an arm operation lever and a rotating operation lever. The right operation lever functions as a boom operation lever and a bucket operation lever. In the following description, either or both of the left operation lever and the right operation lever may be referred to as "an attachment operation device", and at least one selected from the left travelling lever, the right travelling lever, the left travelling pedal, and the right travelling pedal may be referred to as "a travelling operation device". The left travelling lever and the right travelling lever may be referred to as "travelling levers", and the left travelling pedal and the right travelling pedal may be referred to as "travelling pedals". Either or both of the left travelling lever and the left travelling pedal may be referred to as "a left travelling operation device", and either or both of the right travelling lever and the right travelling pedal may be referred to as "a right travelling operation device".

A temperature sensor 27 detects the temperature of the operating oil in the operating oil tank T1, and outputs the detected value to the controller 30.

The discharging pressure sensors 28 detect the discharging pressures of the main pumps 14 and output the detected values to the controller 30. In the present embodiment, the discharging pressure sensors 28 include a left discharging pressure sensor 28L that detects the discharging pressure of the left main pump 14L, and a right discharging pressure sensor 28R that detects the discharging pressure of the right main pump 14R.

The operation sensor 29 is a device that detects the content of an operation performed by the operator via the operation device 26. The content of an operation includes, for example, an operation direction, an operation amount (operation angle), and the like. In the present embodiment, the operation sensor 29 is a pressure sensor that detects, in the form of a pressure, the direction in which and the amount by which a lever or a pedal forming the operation device 26 and corresponding to any hydraulic actuator is operated, and outputs the detected value to the controller 30. The content of an operation via the operation device 26 may be detected using an output from a device other than a pressure sensor, such as an operation angle sensor, an acceleration sensor, an angular velocity sensor, a resolver, a voltmeter, an ammeter, and the like.

The controller 30 is an example of a processing circuit, and functions as a control device that controls the excavator 100. In the present embodiment, the controller 30 is constituted by a computer including a CPU, a volatile memory device, a nonvolatile memory device, and the like.

An electromagnetic valve 31 is situated on a conduit line that connects the pilot pump 15 to the pilot port of a control valve 170 in the control valve unit 17, and can change the flow area of the conduit line. In the present embodiment, the electromagnetic valve 31 is an electromagnetic proportional control valve that functions in accordance with a control instruction output from the controller 30. Hence, the controller 30 can supply the operating oil discharged from the pilot pump 15 to the pilot port of the control valve 170 serving as a straight-travel valve, which is an example of a confluence valve, via the electromagnetic valve 31 irrespective of an operation performed by the operator via the operation device 26. Then, the controller 30 can cause a pilot pressure generated by the electromagnetic valve 31 to act on the pilot port of the control valve 170.

Center bypass oil paths 40 are operating oil lines that pass through the control valves situated in the control valve unit 17, and include a left center bypass oil path 40L and a right center bypass oil path 40R.

The control valve 170 is a spool valve serving as a straight-travel valve. In principle, the control valve 170 remains still in a non-travelling state of the excavator 100. In the present embodiment, the control valve 170 switches the circulation of the operating oil such that the operating oil is supplied to the travelling hydraulic motors 20 from the main pumps 14 in such a suitable manner that the straight travelling performance of the lower travelling body 1 can be improved. Specifically, the valve position of the control valve 170 is switchable between a first valve position and a second valve position in accordance with a control instruction from the controller 30.

More specifically, the valve position of the control valve 170 is at the first valve position while travelling operation devices are only being operated or while attachment operation devices are only being operated, and is at the second valve position while travelling operation devices and attachment operation devices are simultaneously being operated. As described above, in principle, the control valve 170 remains still in the non-travelling state of the excavator 100. That is, the valve position of the control valve 170 is kept at the first valve position unless travelling operation devices and attachment operation devices are simultaneously operated.

Figure 3:
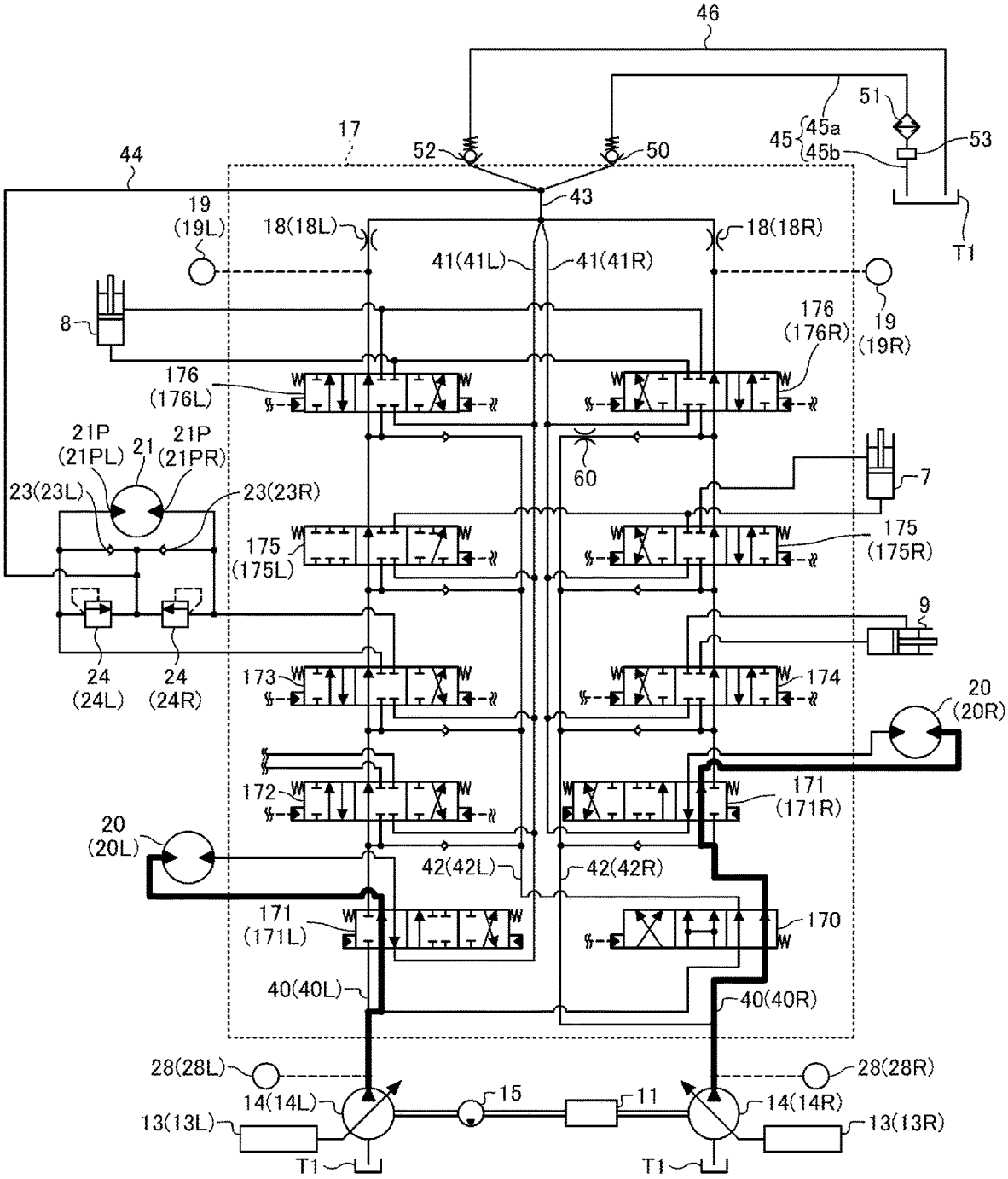
FIG. 3 is a diagram illustrating a state of the driving system while the excavator is travelling.

The first valve position is a valve position at which the left main pump 14L and the left travelling hydraulic motor 20L are brought into communication with each other, and the right main pump 14R and the right travelling hydraulic motor 20R are brought into communication with each other. FIG. 3 illustrates a state of the driving system in a case of performing operations only on travelling operation devices and switching the control valve 170 to the first valve position. Specifically, FIG. 3 illustrates a state of the driving system while the left travelling lever and the right travelling lever are being operated in the forward travelling direction by the same operation amount. In this state, the left main pump 14L can supply the operating oil to the left travelling hydraulic motor 20L, and the right main pump 14R can supply the operating oil to the right travelling hydraulic motor 20R. For clarity, FIG. 3 denotes the operating oil flowing from the left main pump 14L to the left travelling hydraulic motor 20L and the operating oil flowing from the right main pump 14R to the right travelling hydraulic motor 20R by bold solid lines.

Figure 4:
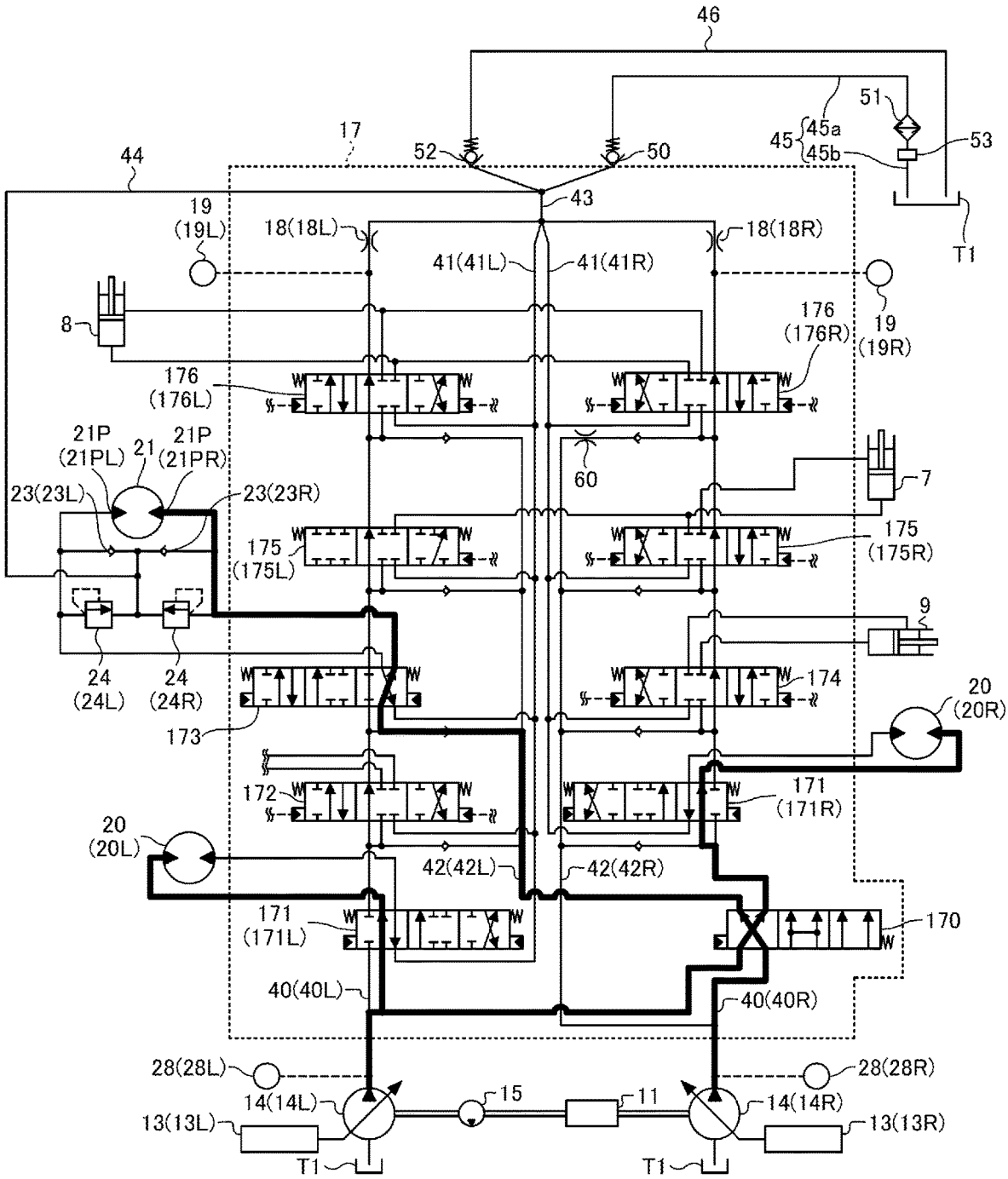
FIG. 4 is a diagram illustrating a state of the driving system while the excavator is rotating while travelling.

The second valve position is a valve position at which the left main pump 14L is brought into communication with each of the left travelling hydraulic motor 20L and the right travelling hydraulic motor 20R. FIG. 4 illustrates a state of the driving system while travelling operation devices and an attachment operation device are simultaneously being operated and the valve position of the control valve 170 is at the second valve position. Specifically, FIG. 4 illustrates a state of the driving system while the left travelling lever and the right travelling lever are being operated in the forward travelling direction by the same operation amount, and the left operation lever serving as the rotating operation lever is being operated in the right rotating direction. In this state, the left main pump 14L can supply the operating oil to each of the left travelling hydraulic motor 20L and the right travelling hydraulic motor 20R. For clarity, FIG. 4 denotes the operating oil flowing from the left main pump 14L to each of the left travelling hydraulic motor 20L and the right travelling hydraulic motor 20R, and the operating oil flowing from the right main pump 14R to the rotating hydraulic motor 21 by bold solid lines.

The control valve 170 can merge the operating oil discharged from the left main pump 14L and the operating oil discharged from the right main pump 14R with each other when its valve position is at a middle valve position between the first valve position and the second valve position.

The controller 30 can supply the operating oil discharged from the pilot pump 15 to the pilot port of the control valve 170 serving as a straight-travel valve by outputting a control instruction (e.g., an instruction by an electric current) to the electromagnetic valve 31 in accordance with an operation performed by the operator via the operation device 26 or irrespective of an operation performed by the operator via the operation device 26. Then, the controller 30 can cause a pilot pressure generated by the electromagnetic valve 31 to act on the pilot port of the control valve 170. Hence, the controller 30 can switch the valve position of the control valve 170 between the first valve position and the second valve position at a desirably selected timing.

Control valves 171 are spool valves that switch the circulation of the operating oil in order to supply the operating oil discharged from the main pumps 14 to the travelling hydraulic motors 20 and expel the operating oil discharged from the travelling hydraulic motors 20 to the operating oil tank. Specifically, the control valves 171 include a control valve 171L and a control valve 171R. The control valve 171L switches the circulation of the operating oil in order to supply the operating oil discharged from the left main pump 14L to the left travelling hydraulic motor 20L and expel the operating oil discharged from the left travelling hydraulic motor 20L to the operating oil tank. The control valve 171R switches the circulation of the operating oil in order to supply the operating oil discharged from the left main pump 14L or the right main pump 14R to the right travelling hydraulic motor 20R and expel the operating oil discharged from the right travelling hydraulic motor 20R to the operating oil tank.

A control valve 172 is a spool valve that switches the circulation of the operating oil in order to supply the operating oil discharged from the left main pump 14L to an optional hydraulic actuator and expel the operating oil discharged from the optional hydraulic actuator to the operating oil tank. The optional hydraulic actuator is, for example, a grapple opening/closing cylinder.

A control valve 173 is a spool valve that switches the circulation of the operating oil in order to supply the operating oil discharged from the left main pump 14L to the rotating hydraulic motor 21 and expel the operating oil discharged from the rotating hydraulic motor 21 to the operating oil tank.

A control valve 174 is a spool valve that supplies the operating oil discharged from the right main pump 14R to the bucket cylinder 9 and expels the operating oil in the bucket cylinder 9 to the operating oil tank.

Control valves 175 are spool valves that switch the circulation of the operating oil in order to supply the operating oil discharged from the main pumps 14 to the boom cylinder 7 and expel the operating oil in the boom cylinder 7 to the operating oil tank. Specifically, the control valves 175 include a control valve 175L and a control valve 175R. The control valve 175L moves only when an operation to raise the boom 4 is performed, and does not move when an operation to lower the boom 4 is performed.

Control valves 176 are spool valves that switch the circulation of the operating oil in order to supply the operating oil discharged from the main pumps 14 to the arm cylinder 8 and expel the operating oil in the arm cylinder 8 to the operating oil tank. Specifically, the control valves 176 include a control valve 176L and a control valve 176R.

In the present embodiment, the control valves 170 to 176 are pilot-type spool valves, but may be electromagnetic spool valves in a case where the operation device 26 is an electric type.

In a case where the operation levers serving as the operation device 26 are electric types, an amount of a lever operation is input into the controller 30 in the form of an electric signal. An electromagnetic valve is situated between the pilot pump 15 and the pilot port of each of the control valves. The electromagnetic valve functions in accordance with an electric signal from the controller 30. By the electromagnetic valve functioning in this way, the controller 30 can control the electromagnetic valve by means of an electric signal that matches the amount of a lever operation in response to a manual operation using an operation lever being performed, and can thereby increase or decrease the pilot pressure and move each control valve. Each control valve may be constituted by an electromagnetic spool valve as described above. In this case, the electromagnetic spool valve moves in accordance with an electric signal from the controller 30 matching the amount of a lever operation performed on an electric-type operation lever.

Returning oil paths 41 are operating oil lines situated in the control valve unit 17, and include a left returning oil path 41L and a right returning oil path 41R. The operating oil that has flowed out of a hydraulic actuator and passed through the control valves 171 to 176 flows toward the operating oil tank T1 by passing through the returning oil paths 41.

Parallel oil paths 42 are operating oil lines extending in parallel with the center bypass oil paths 40. In the present embodiment, the parallel oil paths 42 include a left parallel oil path 42L extending in parallel with the left center bypass oil path 40L, and a right parallel oil path 42R extending in parallel with the right center bypass oil path 40R. The left parallel oil path 42L can supply the operating oil to the control valves that are on the downstream side of the control valve 171L, 172, 173, or 175L when the circulation of the operating oil passing through the left center bypass oil path 40L is limited or interrupted by the control valve 171L, 172, 173, or 175L. The right parallel oil path 42R can supply the operating oil to the control valves that are on the downstream side of the control valves 171R, 174, or 175R when the circulation of the operating oil passing through the right center bypass oil path 40R is limited or interrupted by the control valves 171R, 174, or 175R.

A throttle 60 is a fixed throttle situated on a position of the right parallel oil path 42R that is on the upstream side of the control valve 176R and on the downstream side of a branching point at which an oil path that joins the right parallel oil path 42R and the control valve 175R branches from the right parallel oil path 42R. In the illustrated example, for example, the throttle 60 has a function for preventing the operating oil discharged from the right main pump 14R from mostly flowing into the arm cylinder 8 that is under a low load pressure while the arm cylinder 8 that is under the low load pressure and a hydraulic actuator (at least one selected from the boom cylinder 7, the bucket cylinder 9, and the right travelling hydraulic motor 20R) that is under a high load pressure are simultaneously being operated. The throttle 60 can function in this way because it can increase the pressure on the operating oil on its downstream side when the operating oil is going to flow into the arm cylinder 8 through the control valve 176R. Hence, even while, for example, the arm cylinder 8 under a low load pressure and the boom cylinder 7 under a high load pressure are being simultaneously operated, the driving system including the throttle 60 can reliably drive not only the arm cylinder 8 under the low load pressure but also the boom cylinder 7 under the high load pressure. The same applies in a case where the arm cylinder 8 that is under a low load pressure and the bucket cylinder 9 or the right travelling hydraulic motor 20R that is under a high load pressure are being simultaneously operated.

Here, negative control employed by the driving system of FIG. 2 will be described. Throttles 18 are situated on positions of the center bypass oil paths 40 that respectively are between the most downstream control valves 176 and the operating oil tank T1. The circulation of the operating oil discharged from the main pumps 14 is limited by the throttles 18. The throttles 18 generate control pressures (negative control pressures) for controlling the pump regulators 13. Specifically, the throttles 18 are fixed throttles having a fixed opening area, and include a left throttle 18L and a right throttle 18R. The throttles 18 tend to have a higher stability to a sudden change in a control pressure as the opening area is larger. The throttles 18 tend to have a higher responsiveness to a control pressure as the opening area is smaller. The circulation of the operating oil discharged from the left main pump 14L is limited by the left throttle 18L. Then, the left throttle 18L generates a control pressure for controlling the left pump regulator 13L. Likewise, the circulation of the operating oil discharged from the right main pump 14R is limited by the right throttle 18R. Then, the right throttle 18R generates a control pressure for controlling the right pump regulator 13R.

Control pressure sensors 19 are sensors that detect control pressures (negative control pressures) generated on the upstream side of the throttles 18, and include a left control pressure sensor 19L and a right control pressure sensor 19R. In the present embodiment, the control pressure sensors 19 output detected values to the controller 30. The controller 30 outputs instructions corresponding to the control pressures to the pump regulators 13. The pump regulators 13 control the discharging amounts of the main pumps 14 by adjusting the swash plate tilt angles of the main pumps 14 in accordance with the instructions. Specifically, the pump regulators 13 regulate the discharging amounts of the main pumps 14 to be lower as the control pressures are higher, and regulate the discharging amounts of the main pumps 14 to be higher as the control pressures are lower.

By negative control, the driving system of FIG. 2 can suppress wasteful energy consumption in the main pumps 14 while none of the hydraulic actuators are being operated. Wasteful energy consumption includes a pumping loss generated in the center bypass oil paths 40 by the operating oil discharged from the main pumps 14. It is ensured that while any hydraulic actuator is being operated, a necessary and sufficient operating oil can be reliably supplied to the hydraulic actuator, which is the target being operated, from the main pumps 14.

The center bypass oil paths 40 and the returning oil paths 41 are connected on the downstream side of the throttles 18 to a junction to an oil path 43. The oil path 43 bifurcates on the downstream side of the junction, to be connected to an oil path 45 and to an oil path 46 that are outside the control valve unit 17. That is, flows of the operating oil flowing respectively through the center bypass oil paths 40 and the returning oil paths 41 arrive at the operating oil tank T1 by passing through the oil path 45 or the oil path 46 after merging with each other in the oil path 43. The oil path 43 is also connected to the rotating hydraulic motor 21 through the oil path 44, which is the operating oil line for making up any shortage in the operating oil on the suctioning side of the rotating hydraulic motor 21.

The oil path 45 is an operating oil line connecting the oil path 43 and the operating oil tank T1. A check valve 50, an oil cooler 51, and a filter 53 are situated on the oil path 45.

The check valve 50 is a valve that opens in response to a pressure difference between the primary side and the secondary side becoming higher than a predetermined valve-opening pressure difference. In the present embodiment, the check valve 50 is a spring-type non-return valve, and opens and flows the operating oil out of the control valve unit 17 into the oil cooler 51 in a case where the pressure on the upstream side is higher than the pressure on the downstream side and the pressure difference is higher than the valve-opening pressure difference. The check valve 50 functioning in this way can maintain the pressures on the operating oil in the oil path 43 and the oil path 44 at a level higher than the valve-opening pressure, and ensures reliable makeup for any shortage in the operating oil on the suctioning side of the rotating hydraulic motor 21. In this case, the valve-opening pressure is the lower limit of the back-pressure with respect to the throttles 18. The back-pressure with respect to the throttles 18 increases as the flow rate of the operating oil passing through the check valve 50 increases. The check valve 50 may be combined with the control valve unit 17, or may be omitted. In a case where the check valve 50 is omitted, a pressure drop in each of the oil path 45, the oil cooler 51, and the filter 53 forms the back-pressure with respect to the throttles 18, and the back-pressure with respect to the throttles 18 increases as the flow rate of the operating oil passing through the oil path 45 increases.

The oil cooler 51 is a device that cools the operating oil circulating through the driving system. In the present embodiment, the oil cooler 51 is included in a heat exchanger unit, which is cooled by a cooling fan driven by the engine 11. The heat exchanger unit includes a radiator, an intercooler, the oil cooler 51, and the like. In the present embodiment, the oil path 45 includes an oil path portion 45*a* connecting the check valve 50 and the oil cooler 51, and an oil path portion 45*b* connecting the oil cooler 51 and the operating oil tank T1. The filter 53 is situated on the oil path portion 45*b*.

The oil path 46 is a bypass oil path that bypasses the oil cooler 51. In the present embodiment, one end of the oil path 46 is connected to the oil path 43, and the other end thereof is connected to the operating oil tank T1. The one end may be connected to the oil path 45 between the check valve 50 and the oil cooler 51. A check valve 52 is situated on the oil path 46.

Like the check valve 50, the check valve 52 is a valve that opens in response to a pressure difference between the primary side and the secondary side becoming higher than a predetermined valve-opening pressure difference. In the present embodiment, the check valve 52 is a spring-type non-return valve, and opens and flows the operating oil out of the control valve unit 17 into the operating oil tank T1 in a case where the pressure on the upstream side is higher than the pressure on the downstream side and the pressure difference is higher than the valve-opening pressure difference. The valve-opening pressure difference of the check valve 52 is higher than the valve-opening pressure difference of the check valve 50. Hence, the operating oil in the control valve unit 17 flows first through the check valve 50, and flows next through the check valve 52 in the event of a pressure increase to a level higher than the valve-opening pressure due to any resistance in flowing through the oil cooler 51. The check valve 52 may be combined with the control valve unit 17.

Figure 5:
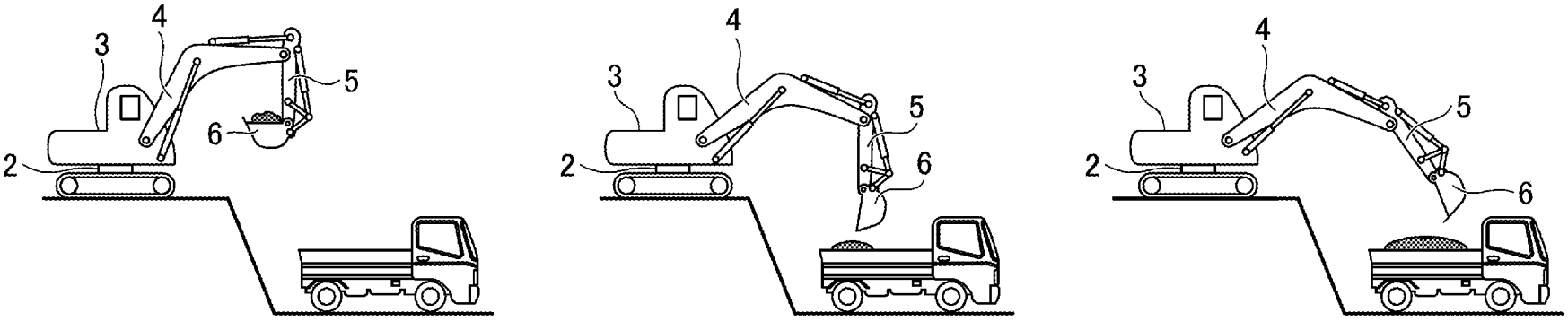
FIG. 5 is a diagram illustrating the flow of a loading work.
Figure 6:
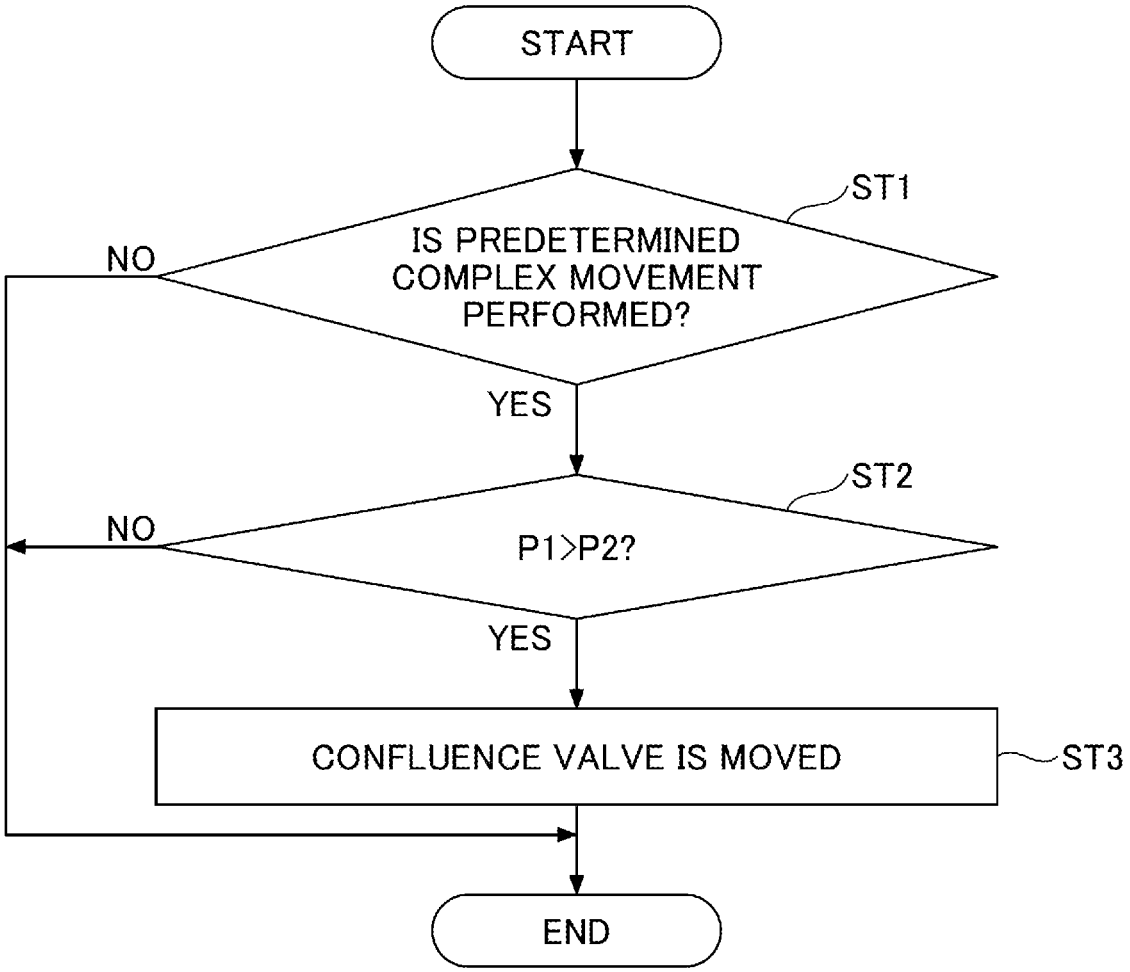
FIG. 6 is a flowchart illustrating the flow of an example of a movement stabilization process.

Next, a movement stabilization process will be described with reference to FIG. 5 and FIG. 6. The movement stabilization process is a process for stabilizing the movement of the attachment while a predetermined complex movement is being performed. FIG. 5 is a diagram illustrating the flow of a loading work realized by a complex movement including an arm opening movement, a boom lowering movement, and a bucket opening movement, which is an example of the predetermined complex movement. The loading work is a work for loading soil scooped into the bucket 6 onto a loading platform of a dump truck. FIG. 6 is a flowchart illustrating the flow of the movement stabilization process. The controller 30 performs the movement stabilization process repeatedly at a predetermined control cycle.

As illustrated on the left side of FIG. 5, first, the operator rotates the upper rotating body 3 such that the excavation attachment faces the dump truck, after performing an excavation movement for scooping soil into the bucket 6. Here, the bucket 6 is in a closed state (which is, for example, a state of the bucket 6 being at a bucket angle of 20 degrees or less). The bucket angle is, for example, the degree of opening from the maximumly closed state of the bucket 6 (i.e., a pivoting angle of the bucket 6 about a bucket pin).

Next, as illustrated in the center of FIG. 5, the operator starts the loading work by gradually opening the bucket while gradually lowering the boom 4 and gradually opening the arm 5. Specifically, the operator performs an arm opening movement by a full lever operation or a half lever operation on the arm operation lever, performs a bucket opening movement by a full lever operation or a half lever operation on the bucket operation lever, and performs a boom lowering movement by a micro-operation on the boom operation lever.

The micro-operation means, for example, an operation by a lever operation amount that is less than 20% on the assumption that a lever operation amount when the operation lever is at a neutral position is 0% and a lever operation amount when the operation lever is maximumly inclined is 100%. The full lever operation means, for example, an operation by a lever operation amount that is 80% or greater. The half lever operation means, for example, an operation by a lever operation amount that is 20% or greater and less than 80%.

Next, as illustrated on the right side of FIG. 5, the operator continues the loading work by gradually opening the bucket 6 while gradually opening the arm 5 and gradually lowering the boom 4 from the state illustrated in the center of FIG. 5. Specifically, the operator continues the arm opening movement by a full lever operation or a half lever operation on the arm operation lever, continues the bucket opening movement by a full lever operation or a half lever operation on the bucket operation lever, and continues the boom lowering movement by a micro-operation on the boom operation lever. As a result, soil scooped into the bucket 6 is dumped onto the loading platform of the dump truck.

In a case where the movement stabilization process is not performed in the loading work, the operating oil discharged from the left main pump 14L arrives at the control valve 176L through each of the left center bypass oil path 40L and the left parallel oil path 42L, and then arrives at a rod-side oil chamber of the arm cylinder 8 through the control valve 176L. Part of the operating oil discharged from the right main pump 14R arrives at the control valve 175R through the right parallel oil path 42R, and then arrives at the rod-side oil chamber of the boom cylinder 7 through the control valve 175R. Another part of the operating oil discharged from the right main pump 14R arrives at the control valve 174 through the right parallel oil path 42R, and then arrives at the rod-side oil chamber of the bucket cylinder 9 through the control valve 174. Yet another part of the operating oil discharged from the right main pump 14R arrives at the control valve 174 through the right center bypass oil path 40R and the control valve 171R, and then arrives at the rod-side oil chamber of the bucket cylinder 9 through the control valve 174. The discharging amount of the left main pump 14L is increased to a predetermined discharging amount through the negative control, because the arm operation lever is in a half lever operation. Likewise, the discharging amount of the right main pump 14R is increased to a predetermined discharging amount through the negative control, because the bucket operation lever is in a half lever operation.

In a complex movement including an arm opening movement by a half lever operation on the arm operation lever, a boom lowering movement by a micro-operation on the boom operation lever, and a bucket opening movement by a half lever operation on the bucket operation lever, a major part of the operating oil discharged from the left main pump 14L is supplied into the rod-side oil chamber of the arm cylinder 8, and the remaining part of the operating oil discharged from the left main pump 14L is expelled as is into the operating oil tank T1. That is, the arm opening movement is realized only by the operating oil discharged from the left main pump 14L, and tends not to be affected by the boom lowering movement and the bucket opening movement that are realized by the operating oil discharged from the right main pump 14R.

On the other hand, the operating oil discharged from the right main pump 14R is supplied into the rod-side oil chamber of the bucket cylinder 9 and into that of the boom cylinder 7 that is under a relatively low load pressure, and remaining part of the operating oil discharged from the right main pump 14R is expelled as is into the operating oil tank T1. That is, the boom lowering movement and the bucket opening movement are realized only by the operating oil discharged from the right main pump 14R, and tend not to be affected by the arm opening movement realized by the operating oil discharged from the left main pump 14L.

However, the operating oil discharged from the right main pump 14R has a tendency toward flowing more into the boom cylinder 7 that is under a relatively low load pressure and flowing less into the bucket cylinder 9 that is under a relatively high load pressure. That is, the bucket opening movement realized by the operating oil discharged from the right main pump 14R tends to be affected by the boom lowering movement that is likewise realized by the operating oil discharged from the right main pump 14R. Hence, there is a case where the operator fails to open the bucket 6 at a desired speed matching the moving speed of the arm 5. Specifically, the opening speed of the bucket 6 falls short of the desired speed matching the opening speed of the arm 5.

Hence, by performing the movement stabilization process while a predetermined complex movement such as the complex movement in the loading work is being performed, the excavator 100 according to the present embodiment moves the boom 4, the arm 5, and the bucket 6 with a good balance. Specifically, the controller 30 mounted on the excavator 100 outputs a control instruction to the electromagnetic valve 31 to control the control valve 170, which serves as a confluence valve that remains non-moving in a non-travelling state in principle, to move exceptionally, to thereby merge the operating oil discharged from the left main pump 14L and the operating oil discharged from the right main pump 14R with each other. This is in order to supply the operating oil, which is discharged from the left main pump 14L and is to be supplied into the arm cylinder 8 moving faster than the bucket cylinder 9, partially into the bucket cylinder 9 that is moving more slowly than the arm cylinder 8, i.e., in order to accelerate the movement (pivoting speed) of the bucket cylinder 9 that is slower than the movement (pivoting speed) of the arm cylinder 8.

More specifically, as illustrated in FIG. 6, the controller 30 determines whether a predetermined complex movement is performed or not (step ST1). In the illustrated example, the controller 30 determines whether a predetermined complex movement is performed or not based on an output from the operation sensor 29. The predetermined complex movement includes the complex movement for realizing the loading work. The complex movement for realizing the loading work is, for example, a complex movement including: an arm opening movement realized by a half lever operation on the arm operation lever; a boom lowering movement realized by a micro-operation on the boom operation lever; and a bucket opening movement realized by a half lever operation on the bucket operation lever. The controller 30 may determine whether a predetermined movement is performed or not based on an output from any other sensor than the operation sensor 29. For example, the controller 30 may determine whether a predetermined complex movement is performed or not based on an output from a boom angle sensor, an arm angle sensor, a bucket angle sensor, and the like, or based on an output from an image sensor such as a space recognition device (a camera or a LIDAR) mounted on the upper rotating body 3 and the like.

In a case of determining that no predetermined complex movement is performed (step ST1: NO), the controller 30 terminates the current movement stabilization process, because it can be estimated that no unstable movement of the excavation attachment that may be the target of stabilization is occurring.

In a case of determining that a predetermined complex movement is performed (step ST1: YES), the controller 30 compares the discharging pressure P1 of the left main pump 14L and the discharging pressure P2 of the right main pump 14R (step ST2). In the illustrated example, the controller 30 determines whether or not the discharging pressure P1 of the left main pump 14L detected by the left discharging pressure sensor 28L is higher than the discharging pressure P2 of the right main pump 14R detected by the right discharging pressure sensor 28R.

In a case of determining that the discharging pressure P1 is not higher than the discharging pressure P2 (step ST2: NO), i.e., in a case of determining that the discharging pressure P1 is lower than or equal to the discharging pressure P2, the controller 30 terminates the current movement stabilization process, because it can be estimated that no unstable movement of the excavation attachment that may be the target of stabilization is occurring.

On the other hand, in a case of determining that the discharging pressure P1 is higher than the discharging pressure P2 (step ST2: YES), the controller 30 moves the control valve 170 serving as a confluence valve (step ST3). In the illustrated example, the controller 30 outputs a control instruction to the electromagnetic valve 31, to position the valve position of the control valve 170 at the middle valve position between the first valve position and the second valve position. As a result, the operating oil discharged from the left main pump 14L and the operating oil discharged from the right main pump 14R merge at the control valve 170, and the discharging pressure P1 and the discharging pressure P2 become the same value. In this case, the discharging pressure P1 after the control valve 170 is moved is lower than the discharging pressure P1 before the control valve 170 is moved, and the discharging pressure P2 after the control valve 170 is moved is higher than the discharging pressure P2 before the control valve 170 is moved. The discharging pressure P1 and the discharging pressure P2 being the same value may include the differential pressure between the discharging pressure P1 and the discharging pressure P2 being lower than a previously set predetermined value.

Figure 7:
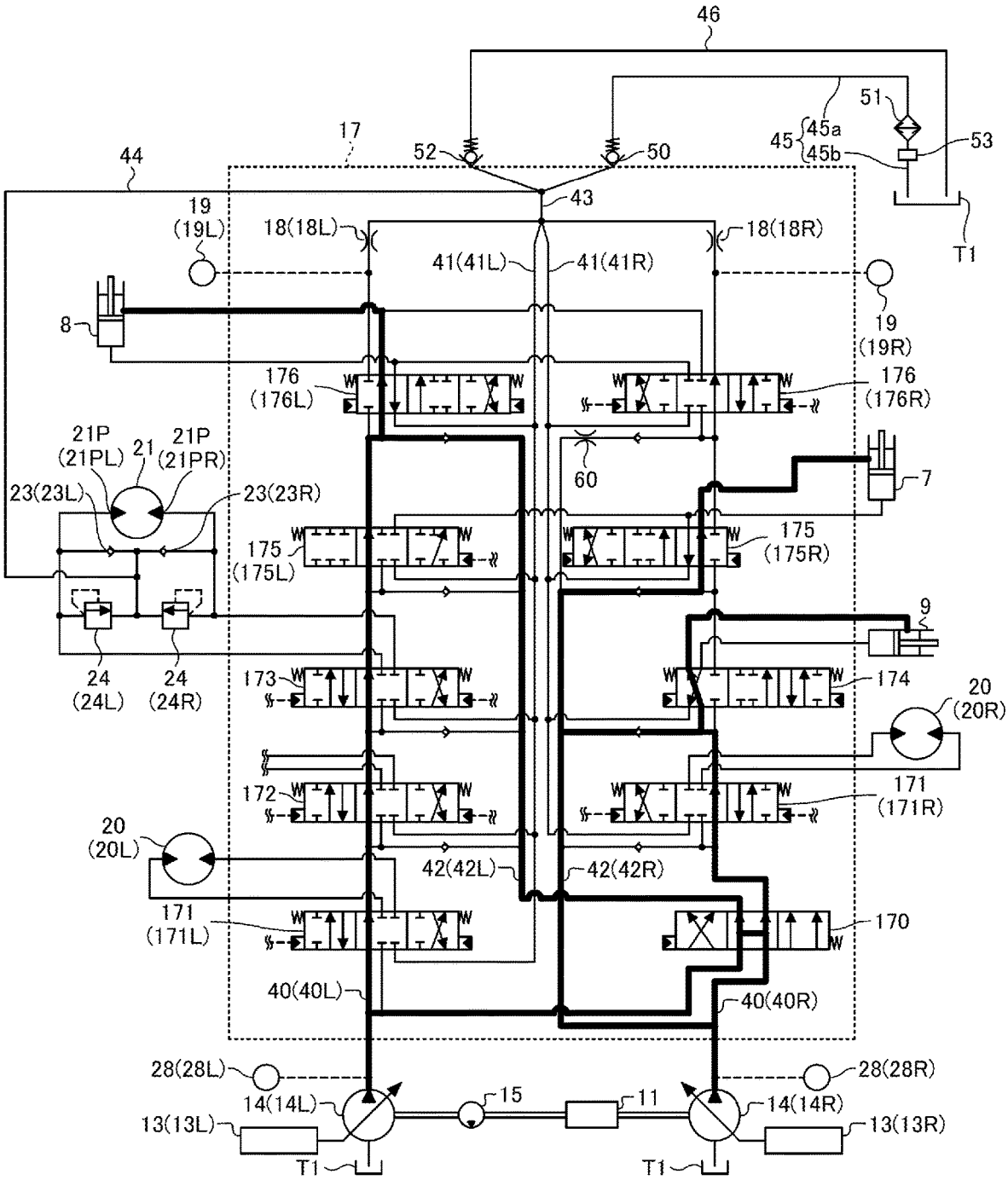
FIG. 7 is a drawing illustrating a state of the driving system while a loading work is being performed.

FIG. 7 illustrates a state of the driving system while the loading work is being performed. Specifically, FIG. 7 illustrates a state of the driving system when the valve position of the control valve 170 is positioned at the middle valve position while a complex movement including a boom lowering movement by a micro-operation, an arm opening movement by a half lever operation, and a bucket opening movement by a half lever operation is being performed. For clarity, FIG. 7 denotes the operating oil flowing into the rod-side oil chamber of the arm cylinder 8 and into the rod-side oil chamber of the bucket cylinder 9 from the left main pump 14L, and the operating oil flowing into the rod-side oil chamber of the boom cylinder 7 and into the rod-side oil chamber of the bucket cylinder 9 from the right main pump 14R by bold solid lines.

As illustrated in FIG. 7, part of the operating oil discharged from the right main pump 14R passes through the right parallel oil path 42R to arrive at the control valve 175R, and then passes through the control valve 175R to arrive at the rod-side oil chamber of the boom cylinder 7. Another part of the operating oil discharged from the right main pump 14R passes through the right parallel oil path 42R to arrive at the control valve 174, and then passes through the control valve 174 to arrive at the rod-side oil chamber of the bucket cylinder 9. Another part of the operating oil discharged from the right main pump 14R passes through the left parallel oil path 42L to arrive at the control valve 176L, and then passes through the control valve 176L to arrive at the rod-side oil chamber of the arm cylinder 8. Part of the operating oil discharged from the left main pump 14L passes through each of the left center bypass oil path 40L and the left parallel oil path 42L to arrive at the control valve 176L, and then passes through the control valve 176L to arrive at the rod-side oil chamber of the arm cylinder 8. When the valve position of the control valve 170 is positioned at the middle valve position, another part of the operating oil discharged from the left main pump 14L passes through the left parallel oil path 42L, the control valve 170, the right center bypass oil path 40R, and the control valve 171R to arrive at the control valve 174, and then passes through the control valve 174 to arrive at the rod-side oil chamber of the bucket cylinder 9.

By performing the movement stabilization process in this way, i.e., by positioning the valve position of the control valve 170 at the middle valve position while a predetermined complex movement is being performed, for example, the controller 30 can accelerate the movement (pivoting speed) of the bucket cylinder 9, which is being slower than the movement (pivoting speed) of the arm cylinder 8. That is, the controller 30 can increase the pivoting speed of the bucket cylinder 9 to a pivoting speed matching the pivoting speed of the arm cylinder 8.

The controller 30 may determine that the discharging pressure P1 is higher than the discharging pressure P2 in a case where the differential pressure between the discharging pressure P1, which is higher than the discharging pressure P2, and the discharging pressure P2 is higher than or equal to a previously set predetermined value. That is, the controller 30 may determine that the discharging pressure P1 is not higher than the discharging pressure P2 even in a case where the discharging pressure P1 is higher than the discharging pressure P2 as long as the differential pressure between them is lower than the predetermined value.

The controller 30 may maintain the control valve 170 in the moved state until a predetermined cancel condition becomes satisfied after the control valve 170 serving as a confluence valve is moved. That is, even after the discharging pressure P1 and the discharging pressure P2 become the same value after the valve position of the control valve 170 is positioned at the middle valve position, the controller 30 may maintain the valve position of the control valve 170 positioned at the middle position unless the predetermined cancel condition becomes satisfied, in order to maintain the state of the part of the operating oil discharged from the left main pump 14L flowing into the bucket cylinder 9. In the illustrated example, the predetermined cancel condition is the predetermined complex movement, which is determined to be performed in the step ST1, being determined to no longer be performed. Specifically, in a typical example, the controller 30 switches the valve position of the control valve 170 to the first valve position in a case of determining that the complex movement including a boom lowering movement, an arm opening movement, and a bucket opening movement, which is determined to be performed in the step ST1, is no longer performed based on an output from the operation sensor 29. Specifically, the controller 30 switches the valve position of the control valve 170 to the first valve position when the complex movement including a boom lowering movement, an arm opening movement, and a bucket opening movement is changed to a single movement including only an arm opening movement or a bucket opening movement.

In the example described above, the controller 30 moves the control valve 170 serving as a confluence valve while a predetermined complex movement, which is a complex movement including an arm opening movement by a half lever operation, a boom lowering movement by a micro-operation, and a bucket opening movement by a half lever operation, is being performed. However, the controller 30 may move the control vale 170 serving as a confluence valve while any other predetermined complex movement is being performed, such as a complex movement including an arm closing movement by a half lever operation, a boom lowering movement by a micro-operation, and a bucket closing movement by a half lever operation, and a complex movement including an arm closing movement by a half lever operation, a boom lowering movement by a micro-operation, and a bucket opening movement by a half lever operation, and the like. The half lever operation in this paragraph may be replaced with a full lever operation.

A complex movement including an arm opening movement by a half lever operation, a boom lowering movement by a micro-operation, and a bucket opening movement by a half lever operation, which is performed to realize the loading work, may be a complex movement including an arm opening movement by a half lever operation, a boom lowering movement by a micro-operation, and a bucket opening movement by a half lever operation, which is performed to realize any other work such as a leveling work, or may be a complex movement including an arm opening movement by a half lever operation, a boom lowering movement by a micro-operation, and a bucket opening movement by a half lever operation, which is performed in the air (in a state in which the excavation attachment does not touch the soil or the like). The half lever operation in this paragraph may be replaced with a full lever operation.

Moreover, in the example described above, the controller 30 moves the control valve 170 serving as a confluence valve while a predetermined complex movement, which is a complex movement including an arm movement, a boom movement, and a bucket movement, is being performed. However, the controller 30 may move the control valve 170 serving as a confluence valve while a predetermined complex movement including at least three selected from an arm movement, a boom movement, a bucket movement, and a rotating movement is being performed. Specifically, the controller 30 may move the control valve 170 serving as a confluence valve while a predetermined complex movement, which is a complex movement including an arm opening movement by a half lever operation, a boom lowering movement by a micro-operation, and a rotating movement by a half lever operation, is being performed. Alternatively, the controller 30 may move the control valve 170 serving as a confluence valve while a predetermined complex movement, which is a complex movement including an arm opening movement by a half lever operation, a bucket opening movement by a half lever operation, and a rotating movement by a micro-operation, is being performed.

As described above, as illustrated in FIG. 1 and FIG. 2, the excavator 100 according to an embodiment of the present invention includes the lower travelling body 1, the upper rotating body 3 mounted rotatably on the lower travelling body 1, the excavation attachment, which is an example of the attachment attached to the upper rotating body 3 and including the boom 4, the arm 5, and the bucket 6, the left main pump 14L serving the first hydraulic pump and the right main pump 14R serving as the second hydraulic pump, which are mounted on the upper rotating body 3, the control valve 170 serving as a confluence valve that merges the operating oil discharged from the left main pump 14L and the operating oil discharged from the right main pump 14R with each other, and the controller 30 serving as a control device that can control the functioning of the control valve 170. The controller 30 moves the control valve 170 to merge the operating oil discharged from the left main pump 14L and the operating oil discharged from the right main pump 14R with each other while at least three selected from the upper rotating body 3, the boom 4, the arm 5, and the bucket 6 are moving simultaneously.

For example, while a complex operation including an arm opening operation by a half lever operation, a boom lowering operation by a micro-operation, and a bucket opening operation by a half lever operation is being performed, only little part of the operating oil from the right main pump 14R flows into the bucket cylinder 9 that is under a high load, because the operating oil from the right main pump 14R is likely to flow into the rod-side oil chamber of the boom cylinder 7 that is under a low load. Hence, in order to increase the operating oil flowing into the bucket cylinder 9, the controller 30 may move the control valve 170 to merge the operating oil discharged from the left main pump 14L and the operating oil discharged from the right main pump 14R with each other.

The controller 30 may determine whether at least three selected from the upper rotating body 3, the boom 4, the arm 5, and the bucket 6 are simultaneously moving or not based on an output from the operation sensor 29. Alternatively, the controller 30 may determine whether at least three selected from the upper rotating body 3, the boom 4, the arm 5, and the bucket 6 are simultaneously moving or not based on an output from a rotating angle sensor, the boom angle sensor, the arm angle sensor, the bucket angle sensor, and the like. Alternatively, the controller 30 may determine whether at least three selected from the upper rotating body 3, the boom 4, the arm 5, and the bucket 6 are simultaneously moving or not based on an output from an image sensor such as a space recognition device (a camera or a LIDAR) mounted on the upper rotating body 3 and the like.

The configuration described above has an effect of enabling inhibiting or preventing an undesired movement of the excavation attachment that may occur while a complex operation for moving the boom cylinder 7, the arm cylinder 8, and the bucket cylinder 9 is being performed. The undesired movement of the excavation attachment is, for example, a movement of the excavation attachment in which the balance between the moving speed of the arm 5 and the moving speed of the bucket 6 (e.g., a ratio of the opening speed of the bucket 6 to the opening speed of the arm 5) changes although the lever operation amount of the arm operation lever and the lever operation amount of the bucket operation lever are not changed.

The configuration described above, which is a configuration for performing the movement stabilization process by using the existing straight-travel valve (the control valve 170), has an effect of enabling merging of the operating oil discharged from the left main pump 14L and the operating oil discharged from the right main pump 14R with each other without employing a relatively expensive method such as situating another independent confluence valve, and the like. Moreover, the configuration described above, which is a configuration for performing the movement stabilization process by using the existing straight-travel valve (the control valve 170), has an effect of enabling merging of the operating oil discharged from the left main pump 14L and the operating oil discharged from the right main pump 14R with each other without employing a structure or a configuration that needs a separate space for installation.

In the example illustrated in FIG. 2, the control valve 170 serving a straight-travel valve is situated between the right main pump 14R and the control valve 171R on the right center bypass oil path 40R, and is situated at the point at which the left parallel oil path 42L is parted to the left main pump 14L side and the control valve 172 side. Basically, the valve position of the control valve 170 serving as a straight-travel valve is switchable while travelling operation devices are being operated. However, in the present embodiment, the valve position of the control valve 170 is switchable even while no travelling operation devices are being operated. Specifically, the control valve 170 serving as a straight-travel valve is switchable between the first valve position at which the control valve 170 can supply the operating oil discharged from the left main pump 14L to the left parallel oil path 42L and can supply the operating oil discharged from the right main pump 14R to the right center bypass oil path 40R, and the second valve position at which the control valve 170 can supply the operating oil discharged from the left main pump 14L to the right center bypass oil path 40R and can supply the operating oil discharged from the right main pump 14R to the left parallel oil path 42L. Moreover, the control valve 170 serving as a straight-travel valve can supply flows of the operating oil, which are discharged from the left main pump 14L and the right main pump 14R respectively, after merging them with each other, to the left parallel oil path 42L and the right center bypass oil path 40R respectively when the control valve 170 is at the middle valve position between the first valve position and the second valve position.

The controller 30 may move the control valve 170 serving as a straight-travel valve to merge the operating oil discharged from the left main pump 14L and the operating oil discharged from the right main pump 14R with each other while a complex movement including an arm opening movement, a boom lowering movement, and a bucket opening movement is being performed.

Alternatively, the controller 30 may move the control valve 170 only when the lever operation amounts of the arm operation lever and the bucket operation lever are each greater than the lever operation amount of the boom operation lever. That is, the controller 30 does not need to move the control valve 170 even while a complex movement including an arm opening movement, a boom lowering movement, and a bucket opening movement is being performed as long as the lever operation amounts of the arm operation lever and the bucket operation lever are each less than or equal to the lever operation amount of the boom operation lever, because it can be estimated that no undesired movement of the excavation attachment is likely to occur.

Alternatively, the controller 30 may move the control valve 170 only while a complex movement including an arm opening movement by a half lever operation, a bucket opening movement by a half lever operation, and a boom lowering movement by a micro-operation is being performed. That is, the controller 30 does not need to move the control valve 170 even while a complex movement including an arm opening movement, a boom lowering movement, and a bucket opening movement is being performed, as long as the arm opening movement is by a micro-operation, as long as the bucket opening movement is by a micro-operation, or as long as the boom lowering operation is by a full lever operation or a half lever operation, because it can be estimated that no undesired movement of the excavation attachment is likely to occur.

As illustrated in FIG. 2, the excavator 100 may include the left main pump 14L serving as a first hydraulic pump that can supply the operating oil to the left travelling hydraulic motor 20L and the right travelling hydraulic motor 20R, and the right main pump 14R serving as a second hydraulic pump that can supply the operating oil to the right travelling hydraulic motor 20R.

In this case, the controller 30 may move the control valve 170 serving as a straight-travel valve to merge the operating oil discharged from the left main pump 14L and the operating oil discharged from the right main pump 14R with each other as illustrated in FIG. 7, in a case where the discharging pressure P1 of the left main pump 14L is higher than the discharging pressure P2 of the right main pump 14R while the boom 4, the arm 5, and the bucket 6 are simultaneously moving in a non-travelling state.

The control valve 170 serving as a straight-travel valve may be switchable between the first valve position at which the left main pump 14L and the left travelling hydraulic motor 20L are brought into communication and the right main pump 14R and the right travelling hydraulic motor 20R are brought into communication as illustrated in FIG. 3, and the second valve position at which the left main pump 14L is brought into communication with each of the left travelling hydraulic motor 20L and the right travelling hydraulic motor 20R as illustrated in FIG. 4.

In this case, the control valve 170 may merge the operating oil discharged from the left main pump 14L and the operating oil discharged from the right main pump 14R with each other when its valve position is at the middle valve position between the first valve position and the second valve position.

This configuration has an effect of enabling inhibiting or preventing occurrence of an undesired movement of the excavation attachment while a complex operation for moving at least three selected from the rotating hydraulic motor 21, the boom cylinder 7, the arm cylinder 8, and the bucket cylinder 9 simultaneously is being performed, because this configuration can flow the operating oil discharged from the left main pump 14L in addition to the operating oil discharged from the right main pump 14R into the bucket cylinder 9, i.e., because this configuration can inhibit or prevent change (worsening) of the balance between the opening speed of the arm 5 and the opening speed of the bucket 6 (e.g., a ratio of the opening speed of the bucket 6 to the opening speed of the arm 5) while, for example, a complex movement including an arm opening movement, a bucket opening movement, and a boom lowering movement is being performed. Hence, this configuration has an effect of enabling improving of the moving speed of the excavation attachment during loading work.

A preferable embodiment of the present invention has been described above. However, the present invention is not limited to the embodiment described above and an embodiment described below. Various modifications, replacements, and the like are applicable to the embodiment described above and an embodiment described below without departing from the scope of the present invention. The features described with reference to the embodiment described above and an embodiment described below may be appropriately combined unless the features technically conflict.

For example, in the embodiment described above, the control valve 170 is formed as a 4-port and 2-chamber spool valve. The controller 30 controls the operating oil discharged from the left main pump 14L and the operating oil discharged from the right main pump 14R to be merged with each other by using the middle valve position of the control valve 170 between the first valve position and the second valve position.

However, the control valve 170 may be formed as a 4-port and 3-chamber spool valve having a middle valve position as an independent third valve position. That is, the control valve 170 may be formed as a 4-port and 3-chamber spool valve having an independent third valve position at which a merging path joining the left parallel oil path 42L and the right center bypass oil path 40R with each other is provided.

The control valve 170 may be able to change the opening area of the merging path joining the left parallel oil path 42L and the right center bypass oil path 40R with each other, depending on the stroke amount of the merging path.

In the embodiment described above, the confluence value is realized by the control valve 170 serving as a straight-travel valve. That is, merging the operating oil discharged from the left main pump 14L and the operating oil discharged from the right main pump 14R with each other is realized by using the middle valve position of the control valve 170 serving as a straight-travel valve. However, the confluence valve may be situated inside the control valve unit 17 or outside the control valve unit 17 as another valve different from the control valve 170 serving as a straight-travel valve.

In the embodiment described above, the operating oil lines may regenerate the operating oil, which flows out from the boom cylinder 7, into the arm cylinder 8 while a complex operation including an arm opening operation or an arm closing operation and a boom lowering operation is being performed. That is, the driving system may include a regeneration circuit that regenerates the operating oil flowing out from the boom cylinder 7 into the arm cylinder 8. Specifically, the operating oil lines may flow the operating oil flowing out from the bottom-side oil chamber of the boom cylinder 7 into the left center bypass oil path 40L through the control valve 175L. Alternatively, the operating oil lines may flow the operating oil flowing out from the bottom-side oil chamber of the boom cylinder 7 directly into the rod-side oil chamber or the bottom-side oil chamber of the arm cylinder 8. This configuration can increase the moving speed of the arm 5 without consuming the output from the driving source while a complex operation including an arm opening operation or an arm closing operation and a boom lowering operation is being performed.

In the configuration including such a regeneration circuit, the balance between the opening speed of the arm 5 and the opening speed of the bucket 6 (e.g., a ratio of the opening speed of the bucket 6 to the opening speed of the arm 5) is at a risk of significantly changing (worsening) in a case where the movement stabilization process is not performed while a complex operation including, for example, an arm opening operation, a bucket opening operation, and a boom lowering operation is being performed, because the opening speed of the arm 5 is likely to increase because of the operating oil flowing out from the boom cylinder 7 being regenerated to the arm cylinder 8 whereas the opening speed of the bucket 6 is likely to decrease because of the operating oil, which should flow into the bucket cylinder 9, flowing into the boom cylinder 7. In this case, the controller 30 can inhibit a significant change (worsening) of the balance between the opening speed of the arm 5 and the opening speed of the bucket 6 (e.g., a ratio of the opening speed of the bucket 6 to the opening speed of the arm 5), by reducing the opening speed of the arm 5 by reducing the discharging amount of the left main pump 14L. However, reducing the discharging amount of the left main pump 14L in turn reduces the speed of the complex movement including the arm opening movement, the bucket opening movement, and the boom lowering movement on the whole.

Hence, by performing the movement stabilization process also in the configuration including such a regeneration circuit, the controller 30 can inhibit or prevent a significant change (worsening) of the balance between the opening speed of the arm 5 and the opening speed of the bucket 6 (e.g., a ratio of the opening speed of the bucket 6 to the opening speed of the arm 5) while a complex operation including an arm opening operation, a bucket opening operation, and a boom lowering operation is being performed, because flowing part of the operating oil discharged from the left main pump 14L into the bucket cylinder 9 can increase the pivoting speed of the bucket 6.

What is claimed is:

1. An excavator, comprising:

a lower travelling body;

an upper rotating body mounted rotatably on the lower travelling body;

an attachment attached to the upper rotating body and including a boom, an arm, and a bucket;

a first hydraulic pump and a second hydraulic pump that are mounted on the upper rotating body;

a confluence valve that merges an operating oil discharged from the first hydraulic pump and the operating oil discharged from the second hydraulic pump with each other; and a control device that can control functioning of the confluence valve, wherein the confluence valve is a straight-travel valve, and the control device moves the straight-travel valve to merge the operating oil discharged from the first hydraulic pump and the operating oil discharged from the second hydraulic pump with each other in a case where a discharging pressure of the first hydraulic pump is higher than a discharging pressure of the second hydraulic pump while at least three selected from the upper rotating body, the boom, the arm, and the bucket are moving simultaneously in a non-travelling state.

2. The excavator according to claim 1, wherein the control device moves the straight-travel valve to merge the operating oil discharged from the first hydraulic pump and the operating oil discharged from the second hydraulic pump with each other while a complex operation including an arm opening operation, a boom lowering operation, and a bucket opening operation is being performed.

3. The excavator according to claim 1, wherein the operating oil flowing out from a boom cylinder is regenerated into an arm cylinder while a complex operation including an arm opening operation or an arm closing operation and a boom lowering operation is being performed.

4. The excavator according to claim 1, wherein the first hydraulic pump can supply the operating oil to a left travelling hydraulic motor and to a right travelling hydraulic motor, the second hydraulic pump can supply the operating oil to the right travelling hydraulic motor, the straight-travel valve is switchable between a first valve position at which the first hydraulic pump and the left travelling hydraulic motor are brought into communication and the second hydraulic pump and the right travelling hydraulic motor are brought into communication, and a second valve position at which the first hydraulic pump is brought into communication with each of the left travelling hydraulic motor and the right travelling hydraulic motor, and the straight-travel valve merges the operating oil discharged from the first hydraulic pump and the operating oil discharged from the second hydraulic pump with each other when the straight-travel valve is at a middle valve position between the first valve position and the second valve position.

* * * * *